US007861445B2

(12) United States Patent
Sui et al.

(10) Patent No.: US 7,861,445 B2
(45) Date of Patent: Jan. 4, 2011

(54) SOLAR POWERED FLOWER OF DYNAMIC SIMULATION

(76) Inventors: Zhiming Sui, 2nd Road Donghuan, Ludong, Humen, Dongguan, Guangdong (CN); Chien-Kuo Hsu, 2nd Road Donghuan, Ludong, Humen, Dongguan, Guangdong (CN)

( * ) Notice: Subject to any disclaimer, the term of this patent is extended or adjusted under 35 U.S.C. 154(b) by 73 days.

(21) Appl. No.: 12/480,596

(22) Filed: Jun. 8, 2009

(65) Prior Publication Data

US 2010/0307569 A1 Dec. 9, 2010

(51) Int. Cl.
*G09F 19/00* (2006.01)

(52) U.S. Cl. ..... 40/414; 40/411; 40/465; 428/24

(58) Field of Classification Search ..... 40/411, 40/414, 465; 428/24
See application file for complete search history.

(56) References Cited

U.S. PATENT DOCUMENTS 549,039 A * 10/1895 Wenger ..... 40/411
4,910,647 A * 3/1990 Gong ..... 362/122
5,522,758 A * 6/1996 Liu et al. ..... 446/310
2006/0254098 A1* 11/2006 Fu ..... 40/411

* cited by examiner

*Primary Examiner*—Cassandra Davis
(74) *Attorney, Agent, or Firm*—Banger Shia

(57) ABSTRACT

The present invention pertains to a solar powered flower of dynamic simulation comprising a stem, a solar power supplier, a connecting base, a driving unit, a movable tray, and plurality of swinging members as well as petals. Wherein, the connecting base fixed on the top end of the stem and peripherally provided with multiple inlaying slots, in which the swinging member is pivoted. Each swinging member provides an upper arm to install a petal, and a lower arm to pivot the movable tray, on which contacts an output terminal of the driving unit for the movable tray to move up- and downward to motivate the vacillation of the swinging member as a seesaw. The petals then swing conforming to the swinging member to bloom and close achieving a dynamic simulation of the reality. When the ornamental states of the flower change according to the light variation in the daytime and at the night, the performance of the product is more close to Nature, which conduces to promote the ornamental function and market competitiveness thereof.

8 Claims, 11 Drawing Sheets

SOLAR POWERED FLOWER OF DYNAMIC SIMULATION

BACKGROUND OF THE INVENTION

1. Field of the Invention

The present invention relates to ikebana, a decorative flower arrangement, in particular to a solar powered flower of dynamic simulation that can radiate and simulate the vivid motion of bloom in the real Nature.

2. Description of the Related Art

Because of the development of economy and the advancing standards of living, people are in pursuit of not only material comforts but further spiritual demands; namely, a cozy, warm, and elegant life environment. Thus, the ornaments that can beautify the environment are more and more favored. Specially, mimic flowers are extensively utilized to decorate the hotels or inns. Wherein, the mimic flower is made of fine fabric, plastic, and steel wire to form a blossom or a bud that are getting ready to burst with colorful flowers and various green leaves so as to perform an almost real flower thereof. Moreover, the mimic flower can be directed to the pure lily or noble chrysanthemum. Further, the mimic flower is advantageous to be readily purged, not easy to be damaged, and can be decorated for a long time. If further lighting is additionally installed in the mimic flower, a graceful and artistic effect of the ornament can be generated at the night.

However, the conventional mimic flower is basically directed to a static simulation; namely, the conventional mimic flower can only be permanently designed as a blossom or a bud ready to burst. Therefore, the conventional mimic flower is not able to automatically vary and is limited. If people desire a different state of the flower, they need to buy another one, which is inconvenient and unsatisfied.

SUMMARY OF THE INVENTION

One object of the present invention is to provide a solar powered flower of dynamic simulation that can imitate the motion of blossom of the petals to attain an almost real simulation.

The other object of the present invention is to provide a solar powered flower of dynamic simulation that can utilize a solar energy board to absorb and sense the variations of light during the day and at the night to correspondingly and automatically change the decorative state itself.

The solar powered flower of dynamic simulation in accordance with the present invention essentially comprises a stem, a solar power supplier, a connecting base, a driving unit, a movable tray, at least one swinging member, and at least one petal. Wherein, a sharp pointed portion is disposed at a distal end of the stem, the connecting base is fixedly installed on a top end of the stem, at least one inlaying slot is disposed on the periphery of the connecting base for the swinging member to be correspondingly pivoted therein, the petal is mounted on an upper arm of the swinging member, the movable tray is pivoted on a lower arm of the swinging member, and the driving unit is electrically connected with the solar power supplier to be provided with sufficient working power therefrom. Further, an output terminal of the driving unit contacts the movable tray, so that the movable tray would be pushed forward to bring the swinging member to vacillate as a seesaw, and the petal would be accordingly moved to perform in bloom or close conforming to the movement of the swinging member.

Preferably, the connecting base includes an upper base and a lower base, and a receiving room is defined on the top side of the lower base. Whereby, the upper base is hermetically disposed upon a cavity of the receiving room, the driving unit is received in the receiving room, and the inlaying slot is disposed on the upper base.

Preferably, the driving unit includes a motor, a gear set, and a slider. Wherein, the slider further provides with an over-and-under extended rack to mesh with a propelling gear of the gear set. Moreover, the motor would motivate the gear set to rotate clockwise or opposite, the gear set would further prompt the slider to move upward and downward, and the movable tray fixedly mounted on the slider would be accordingly moved conforming to the movement of the slider.

Preferably, an opening is defined on the lower arm of the swinging member, and a plurality of shafts are correspondingly installed on the movable tray to pivot into the opening and form a pivoted structure between the swinging member and the movable tray.

Preferably, a radiate member is further installed in the connecting base and the power source thereof is powered by the solar power supplier.

Preferably, the solar power supplier comprises a solar energy board, a rechargeable battery, and a controlling circuit. Wherein, the rechargeable battery is charged by the conversion from light energy absorbed in the solar energy board into electric energy so as to provide the driving unit with sufficient working power.

Preferably, the stem further provides with a stand, the solar energy board is disposed on a battery container, and the battery container is mounted on the stand.

Preferably, the stand includes two pallets, an axle is disposed between two pallets, and a protrusion is defined on the inner wall of the at least one pallet. In addition, a protruding member disposed on the battery container provides with an aperture. Further, a plurality of spacing indentations are defined on at least one side wall of the protruding member, and the spacing indentations are uniformly distributed on the periphery of the aperture. Besides, the protruding member is clipped between the two pallets, the axle is pivotally inserted into the aperture, and the protrusion would be correspondingly embedded into the related spacing indentation for the battery container to form a spinning structure on the stand.

In the manner above, the present invention would utilize the solar power to motivate the driving unit to move the movable tray upward and downward. Accordingly, the swinging member would be triggered by the movement of the movable tray to assist the petal in blossom. Therefore, the blossom simulation of the present invention apparently differentiates from the conventional mimic and static ikebana. As a result, a new dynamic simulation of the mimic flower is developed to automatically change the decorative state itself according to the variation of the environment, which not only provides a function of multiple decorations, and the decorative effect is more close to Nature. Whereby, the ornamental function and the market competitiveness of the product can be greatly promoted.

The advantages of the present invention over the known prior arts will become more apparent to those of ordinary skilled in the art by reading the following descriptions with the relating drawings.

DETAILED DESCRIPTION OF THE PREFERRED EMBODIMENTS

Figure 1:
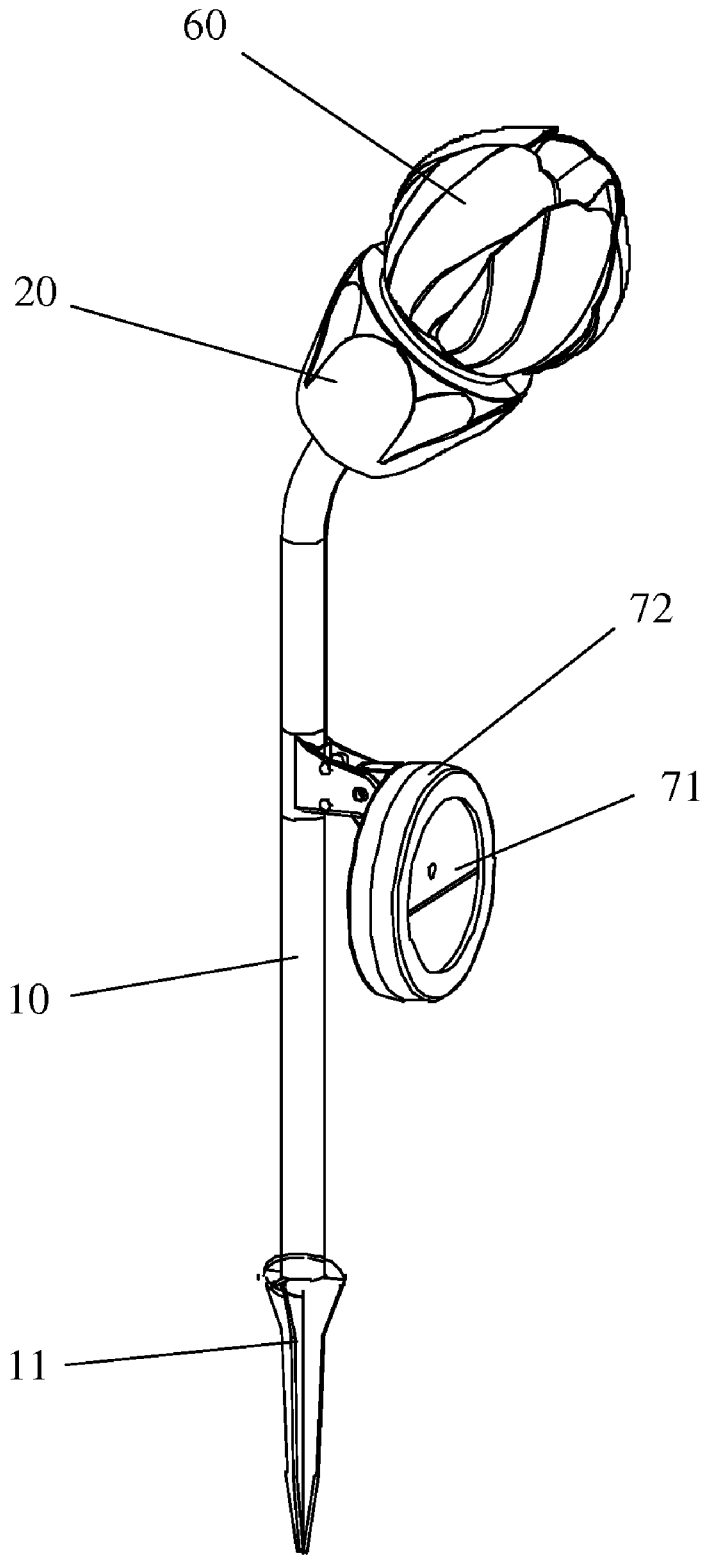
FIG. 1 is perspective view showing the present invention with petals closed.
Figure 2:
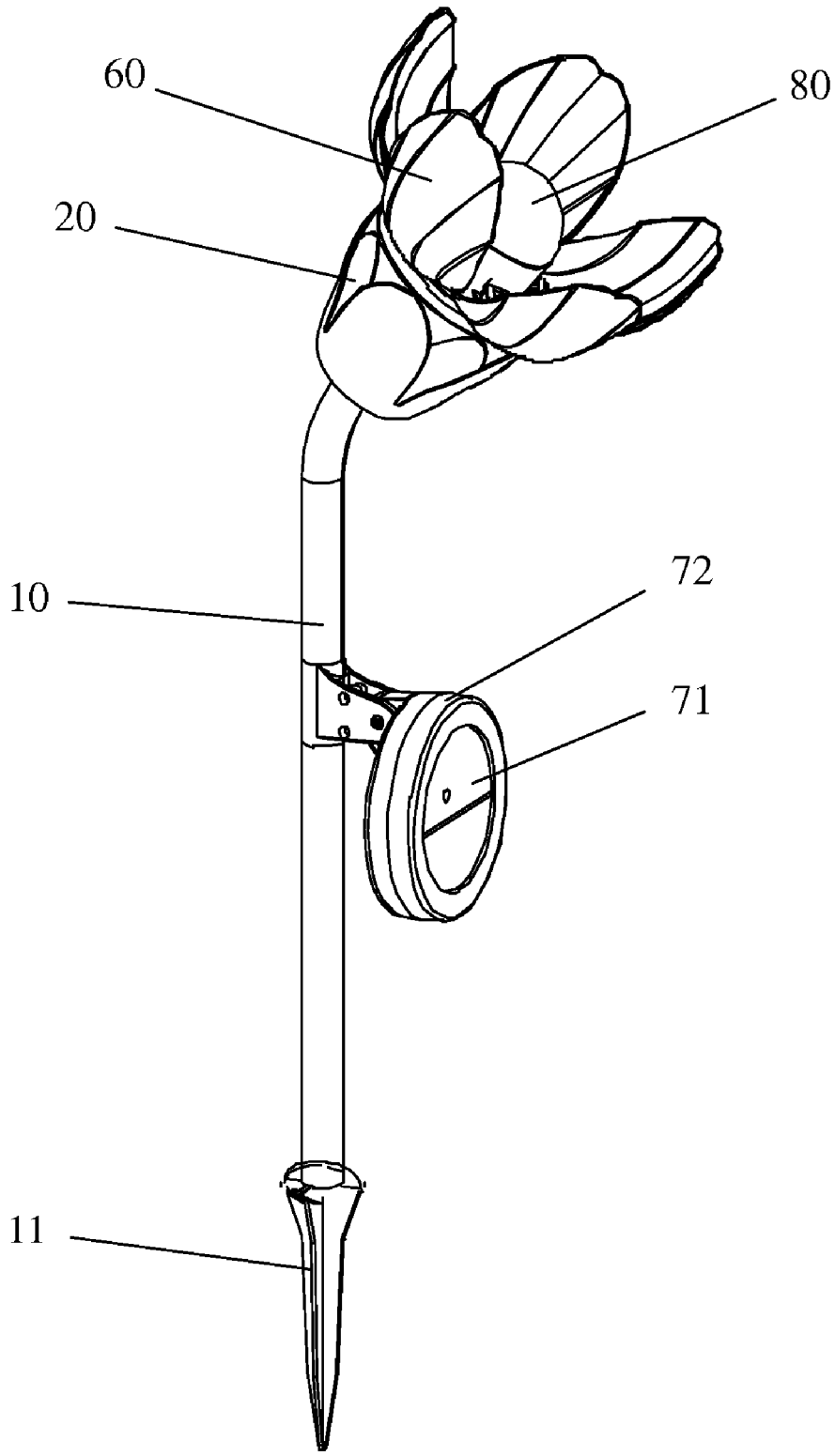
FIG. 2 is a perspective view showing the present invention with petals bloomed.

Referring to FIGS. 1 to 11, a solar powered flower of dynamic simulation comprises a stem 10, a connecting base 20, a driving unit 30, a movable tray 40, five swinging members 50, five petals, and a solar power supplier. Wherein, a sharp pointed portion 11 is disposed at a distal end of the stem 10 as shown in FIG. 1, so that the pointed portion 11 can be readily inserted into a lawn or a flower pot, and the stem 10 has a certain length as a pedicel.

Figure 3:
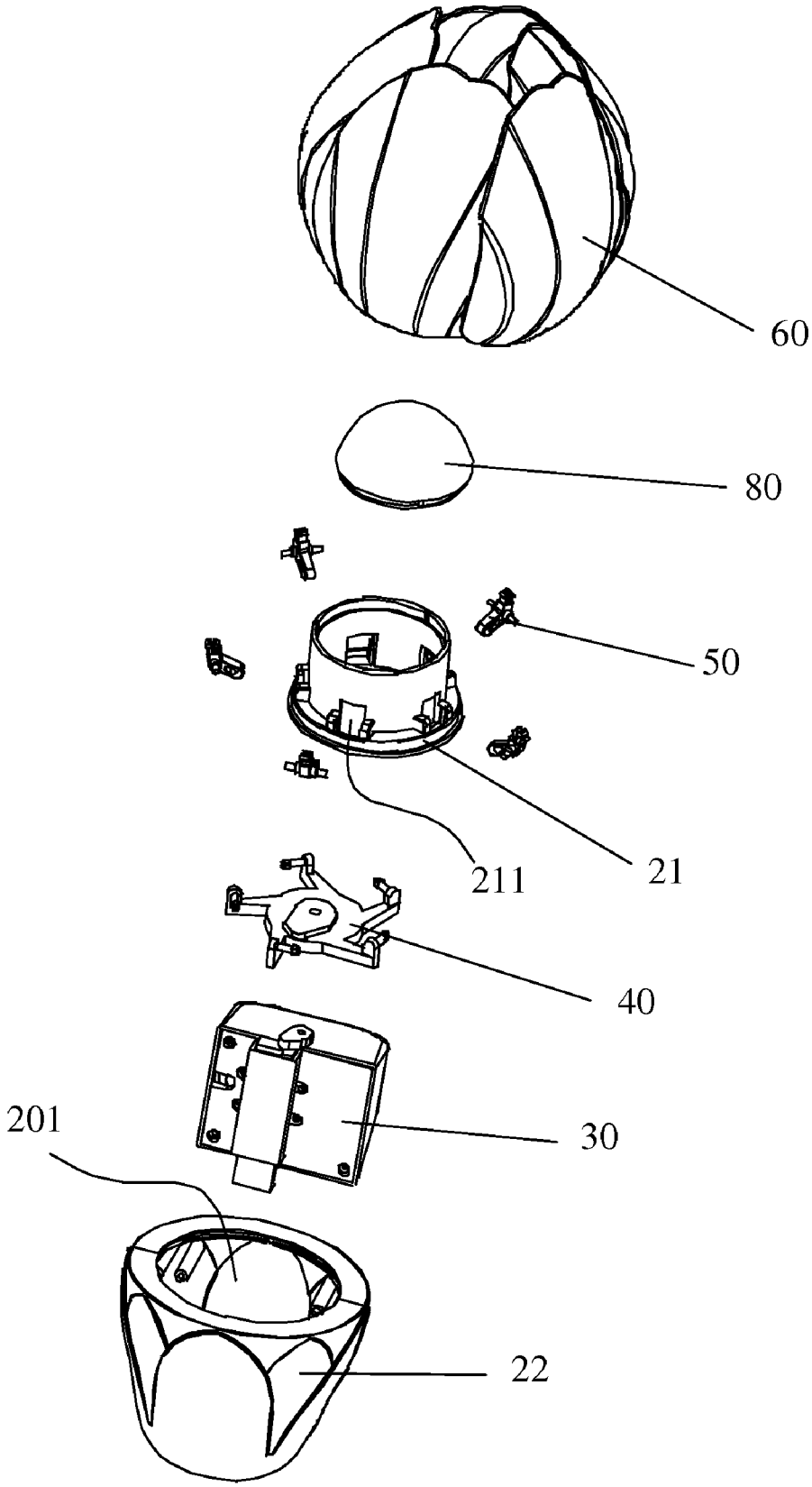
FIG. 3 is an exploded view showing the partial present invention.

Moreover, the connecting base 20 is fixedly installed on a top end of the stem 10 as shown in FIG. 3. Wherein, the connecting base 20 includes an upper base 21 and a lower base 22. A receiving room 201 is further defined on the top side of the lower base 22, and the upper base 21 is hermetically disposed upon a cavity of the receiving room 201. Additionally, five inlaying slots 211 are averagely disposed on the periphery of the upper base 21.

Figure 5:
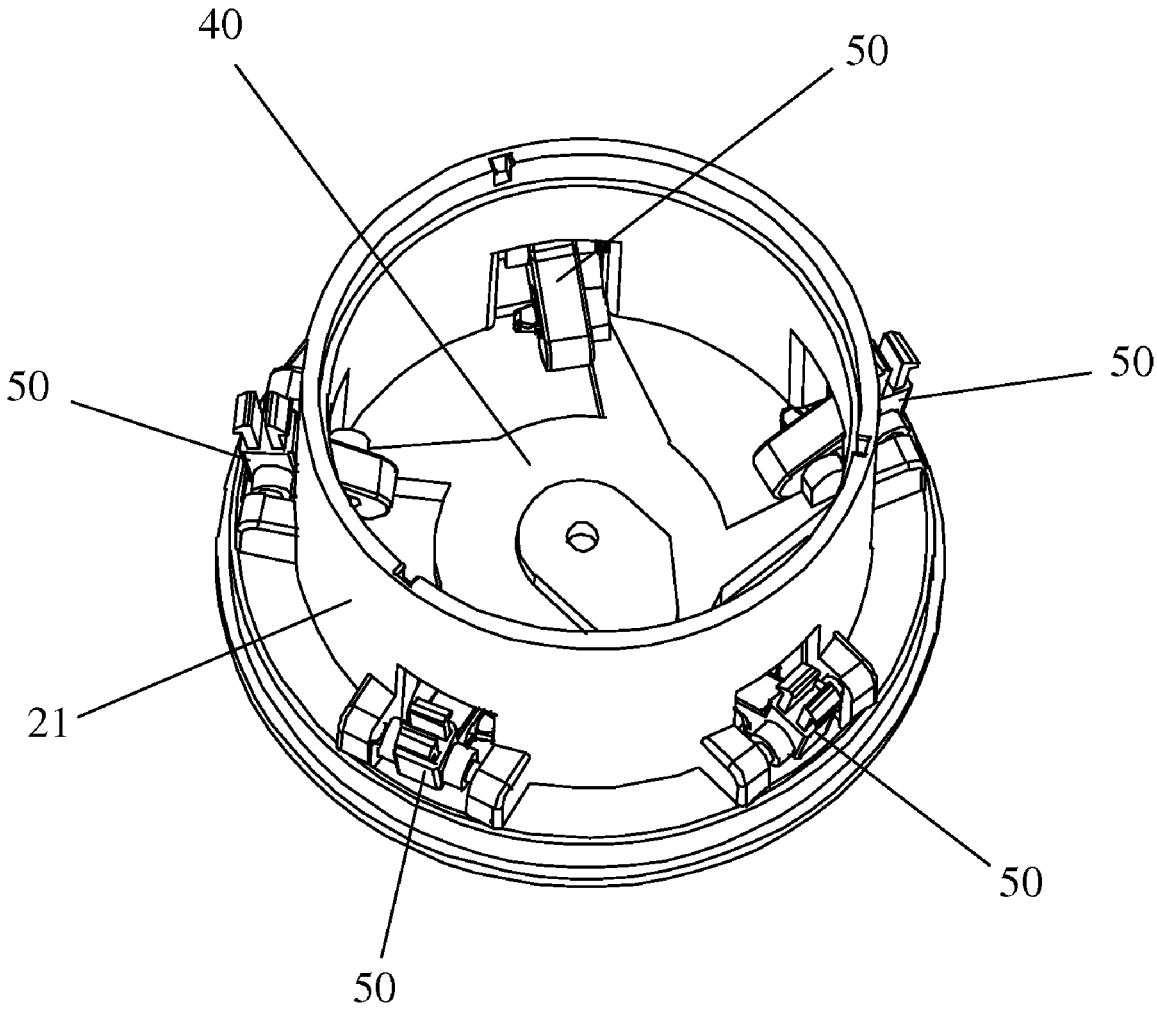
FIG. 5 is a perspective view showing the connecting structure of the upper base, swinging member, and the movable tray.
Figure 6:
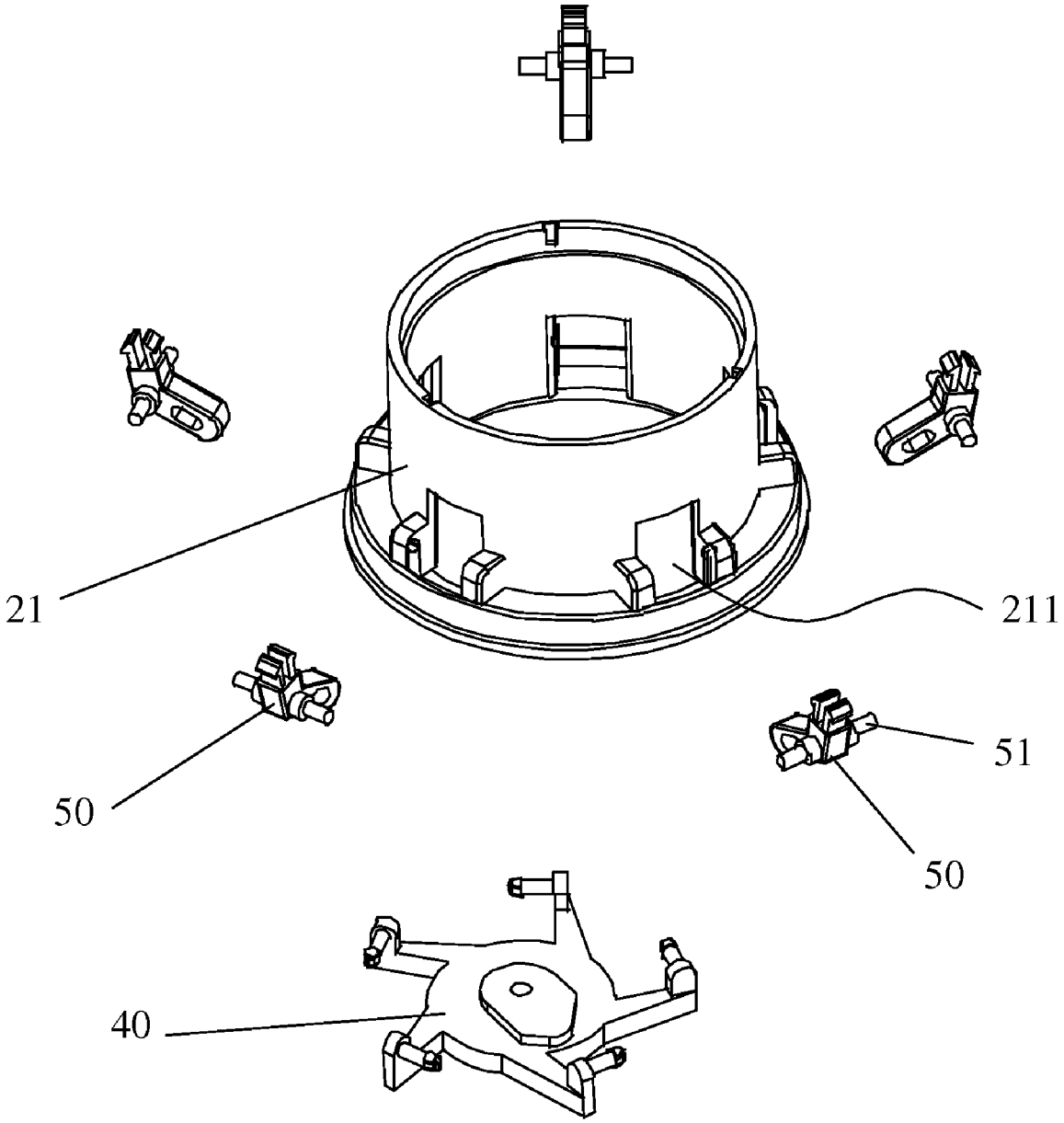
FIG. 6 is an exploded view showing FIG. 5.
Figure 7:
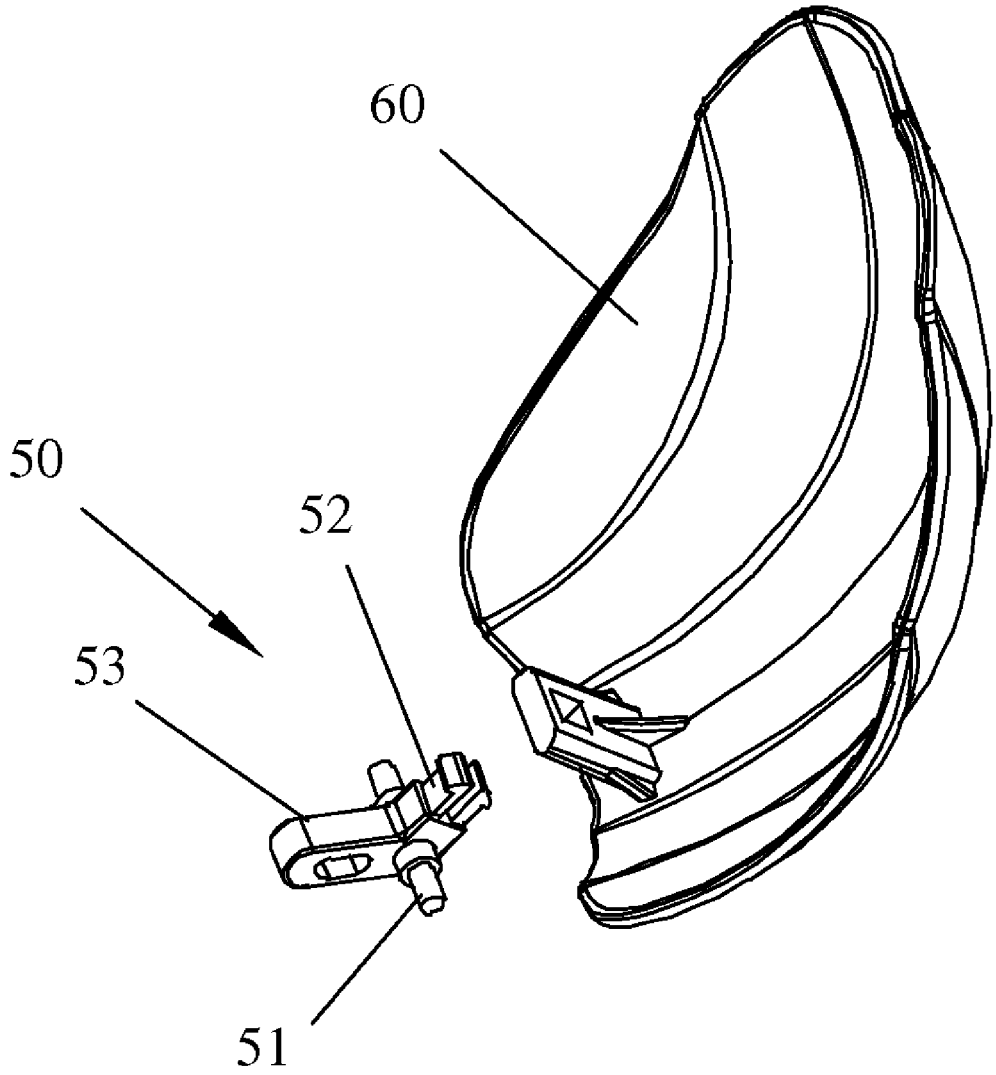
FIG. 7 is an exploded view showing the connecting structure of the swinging member and the petal.

Referring to FIGS. 5 to 7, five swinging members 50 are respectively pivoted on the five inlaying slots 211, and each of the swinging members 50 further includes a rod 51 and an upper arm 52 as well as a lower arm 53, respectively disposed on the two sides of the rods 51. Whereby, the rod 51 is inserted into the apertures defined on the two sides of the inlaying slot 211 to form a pivoting structure of the swinging member 50 and the inlaying slot 211. The five petals 60 are respectively mounted on the upper arms 52 of the five swinging members 50, and an opening 531 is pivoted on each of the lower arms 53 of the swinging member 50.

Figure 4:
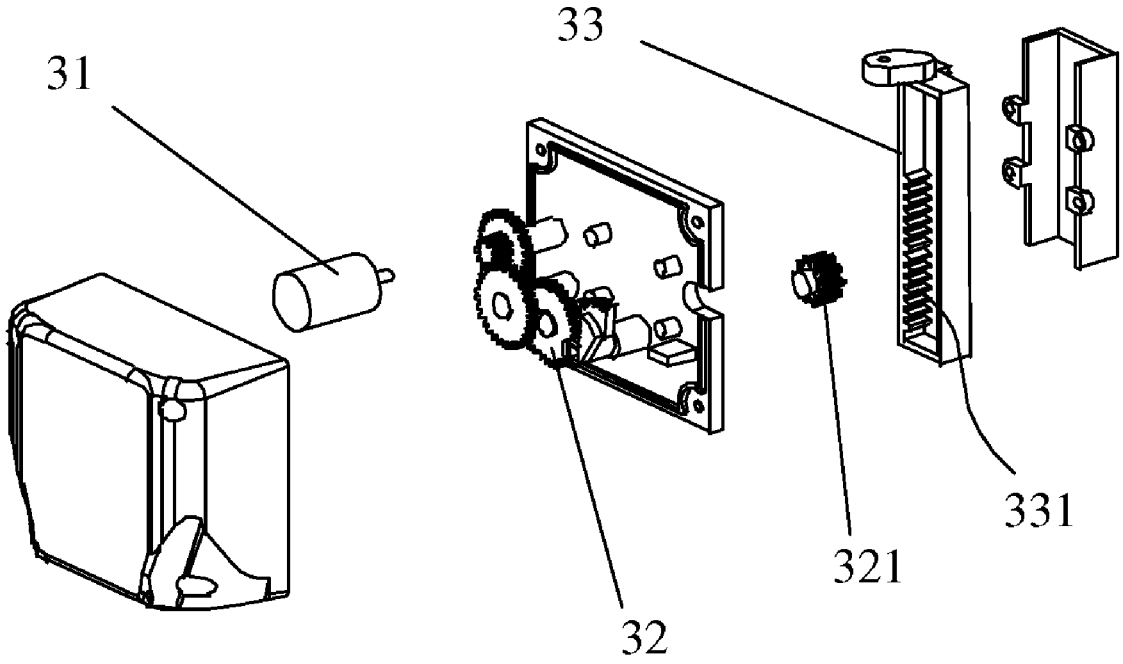
FIG. 4 is an exploded view showing the driving unit of the present invention.
Figure 8:
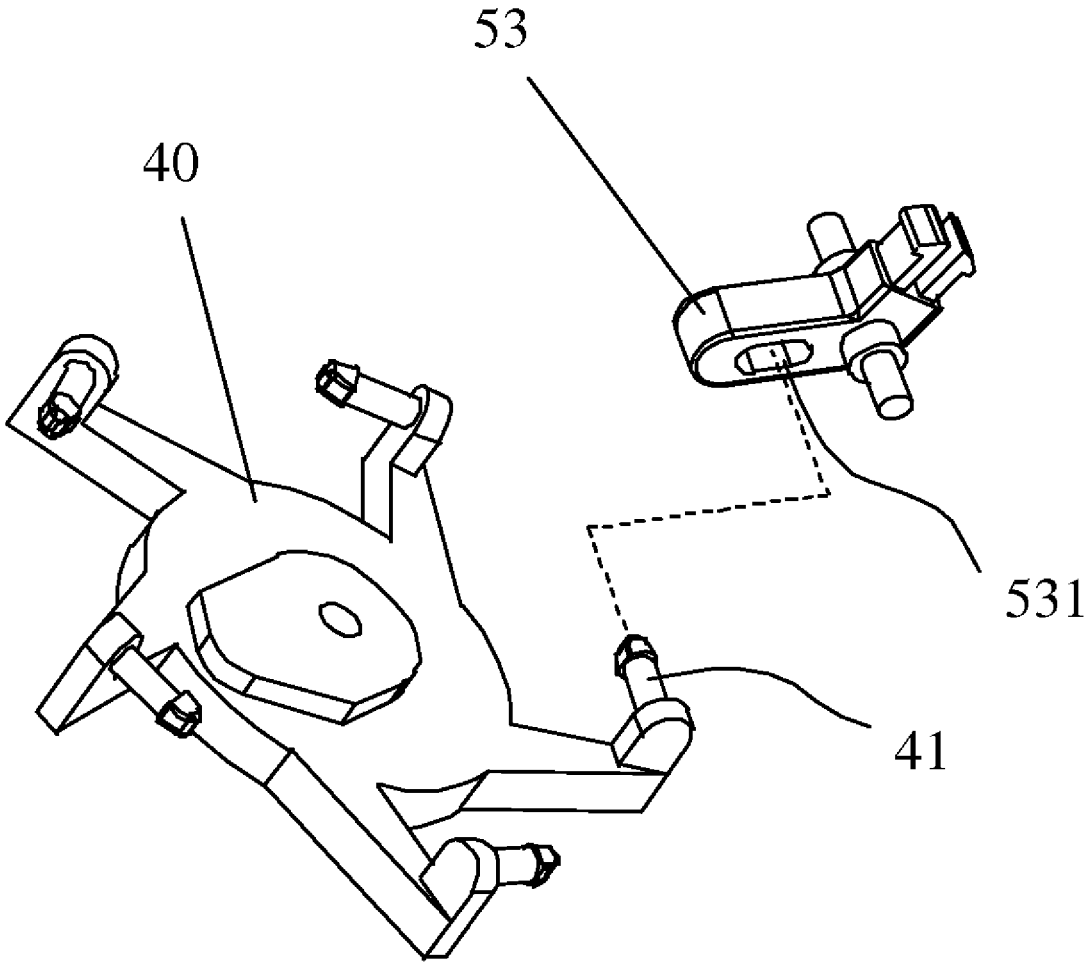
FIG. 8 is an exploded view showing the connecting structure of the swinging member and the movable tray.

Referring to FIG. 4, the driving unit 30 includes a motor 31, a gear set 32, and a slider 33. Wherein, the slider 33 further provides with an over-and-under extended rack 331 to mesh with a propelling gear 321 of the gear set 32. Moreover, the motor 31 would motivate the gear set 32 to rotate clockwise or opposite, and the gear set 32 would further prompt the slider 33 to move upward and downward. Further, the movable tray 40 fixedly mounted on the slider 33 would be accordingly moved conforming to the movement of the slider 33. As shown in FIG. 8, five shafts 41 are installed on the movable tray 40 to respectively pivot into the opening 531 of the swinging member 50.

In addition, the driving unit 30 is electrically connected with the solar power supplier so as to be provided with a sufficient working power therefrom. Wherein, the solar power supplier comprises a solar energy board 71, a rechargeable battery, and a controlling circuit. Whereby, the rechargeable battery is charged by the conversion from light energy absorbed in the solar energy board 71 into electric energy so as to provide the driving unit 30 with sufficient working power.

Figure 11:
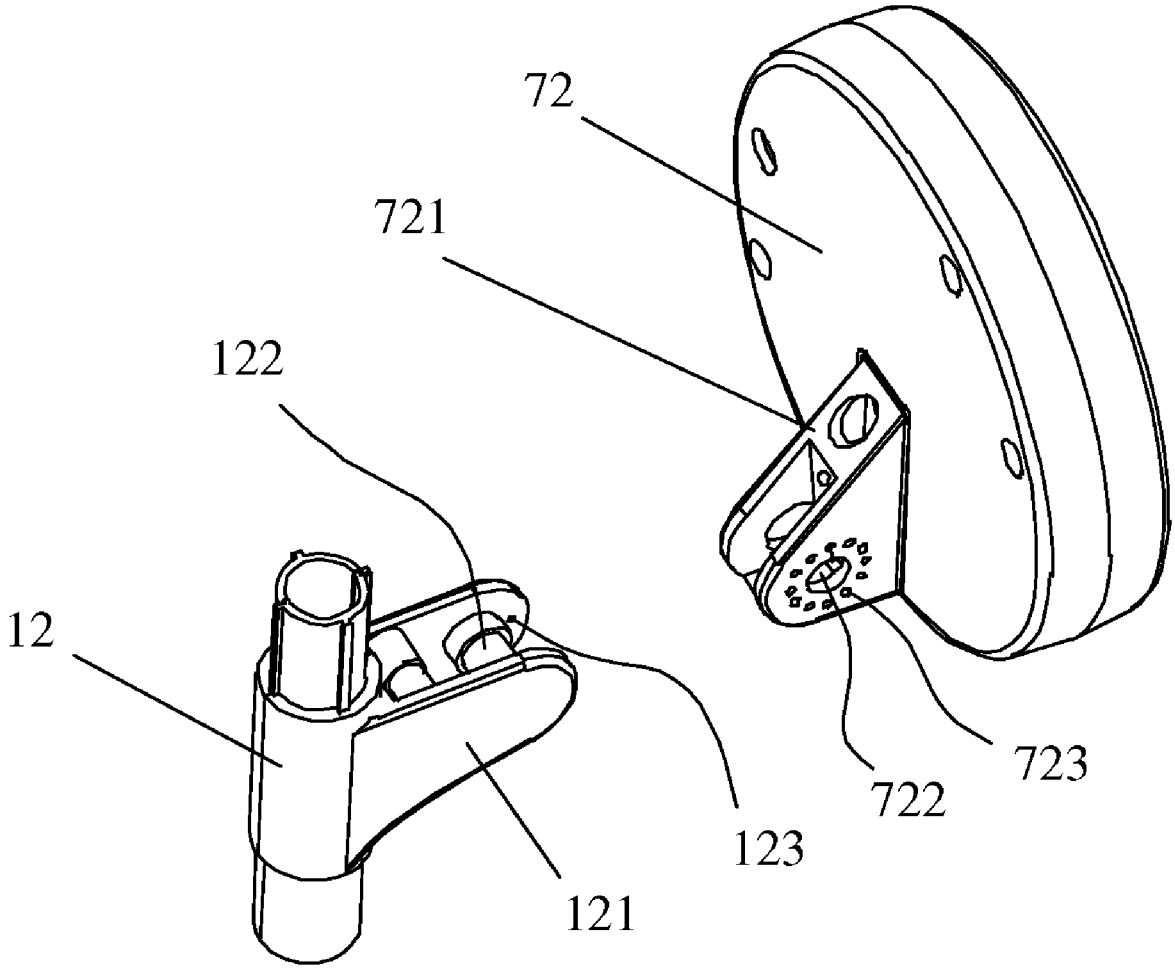
FIG. 11 is an exploded view showing the connecting structure of the stand and the battery container.

Referring to FIGS. 1 and 11, the stem 10 further provides with a stand 12, on which a battery container 72 is mounted, and the solar energy board 71 is disposed on the surface of the battery container 72. Substantially, the stand 12 includes two pallets 121. Wherein, an axle 122 is disposed between the two pallets 121, and a protrusion 123 is defined on the inner wall of the two pallets 121. Moreover, a protruding member 721 disposed on the battery container 72 provides with an aperture 722, a plurality of spacing indentations 723 are defined on the two side walls of the protruding member 721, and the spacing indentations 723 are uniformly distributed on the periphery of the aperture 722. The protruding member 721 is clipped between the two pallets 121, the axle 122 is inserted into the aperture 722, and the protrusion 123 would be correspondingly embedded into the related spacing indentation 723 for the battery container 72 to form a spinning structure on the stand 12. In this manner, the battery container 72 could be adjusted to a suitable position. By the cooperation with the solar energy board 71 mounted on the surface of the battery container 72, users can conveniently adjust the orientation of the receipt of the solar energy, so that the receiving performance of the solar energy could be promoted.

Alternatively, a radiate member 80 is further installed on the upper base 21 of the connecting base 20. Wherein, it is favorable to employ an LED in the radiate member 80 to save energy. In addition, the radiate member 80 is electrically connected to the output terminal of the solar power supplier, so that the solar power supplier would provide the radiate member 80 with sufficient working power.

Figure 10:
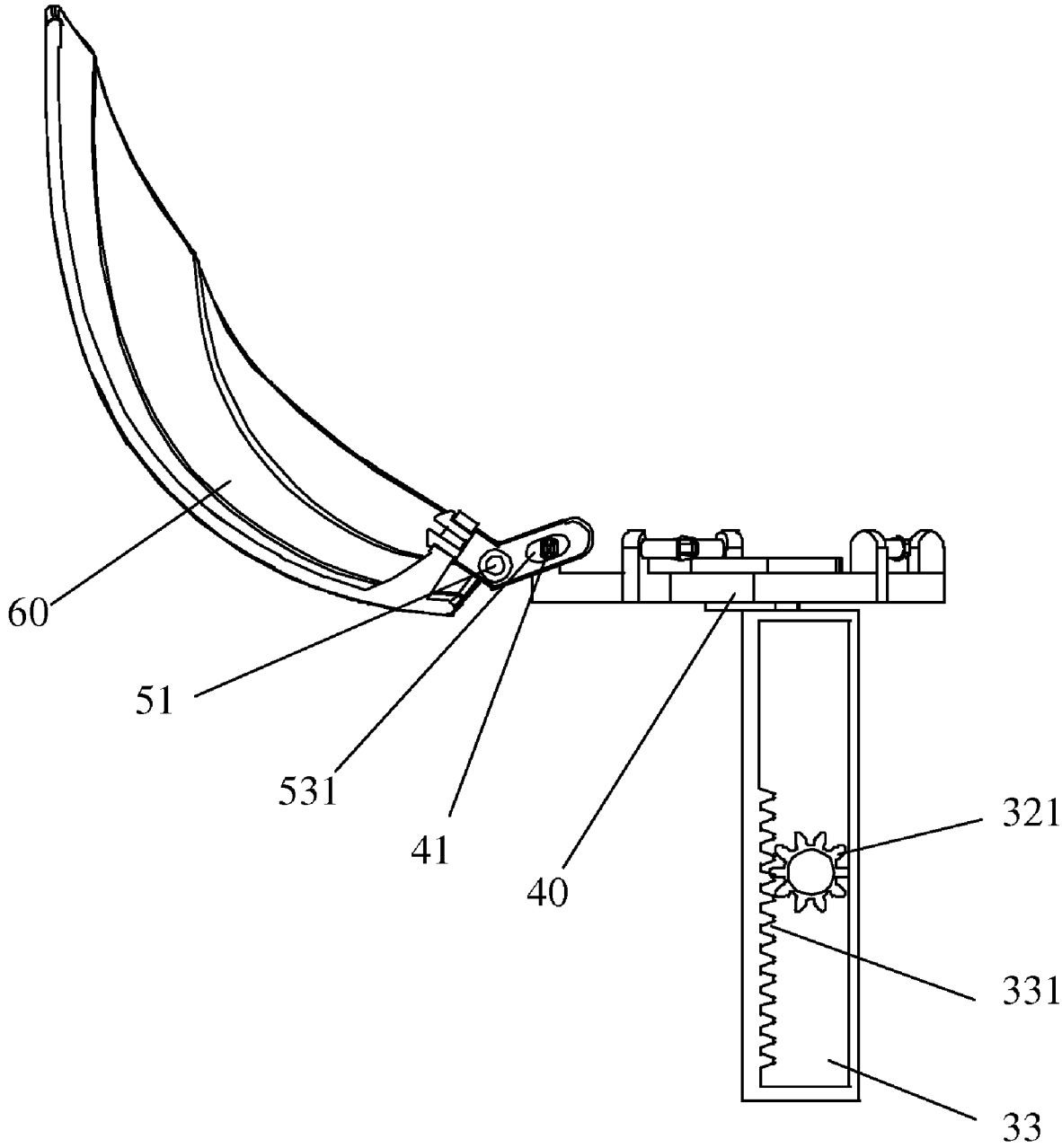
FIG. 10 is a schematic view showing the driving structure of the petal, and the petal is bloomed.

In operation, in the daytime, there is more adequate light for the solar energy board 71 to absorb and to be converted into electricity for the rechargeable battery to be charged. Thus, the rechargeable battery could save enough power for the controlling circuit and the motor 31 to activate. Whereby, the controlling circuit would automatically rotate the motor 31 clockwise, and the motor 31 would bring the gear set 32 and the slider 33 to motivate the movable tray 40 moving upward. Further, the movable tray 40 would trigger the swinging member 50 to outwardly overturn as a seesaw, so that the petal 60 would accordingly turn over as blossom conforming to the movement of the swinging member 50 (as shown in FIG. 10). Concurrently, the controlling circuit would control the radiate member 80 not to radiate for electricity saving.

Figure 9:
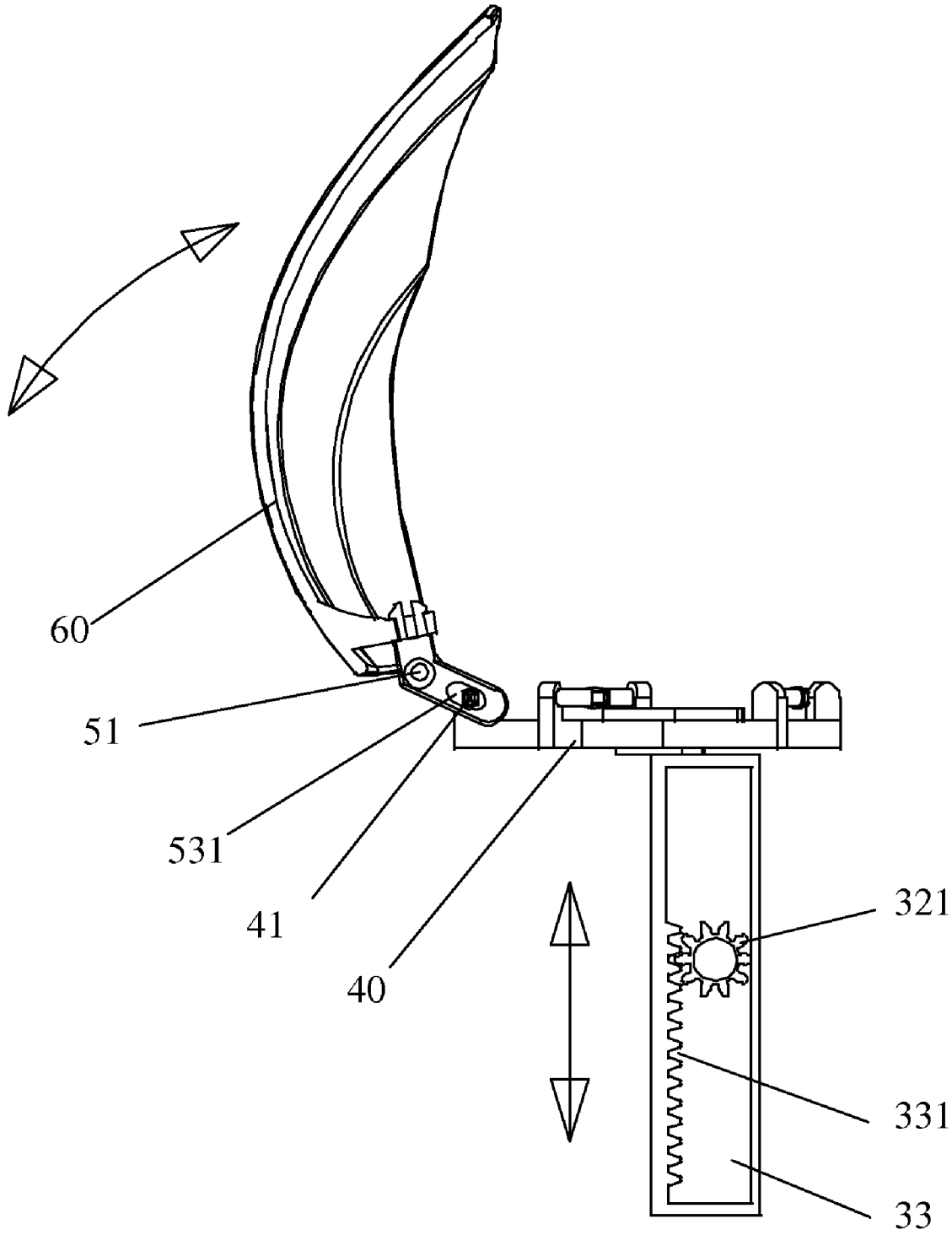
FIG. 9 is a schematic view showing the driving structure of the petal, and the petal is closed.

At the night, the light would fade away, and the controlling circuit would automatically control the motor to rotate oppositely. Concurrently, the motor 31 would bring the gear set 32 and the slider 33 to motivate the movable tray 40 moving downward. Further, the movable tray 40 would trigger the swinging member 50 to inwardly overturn as a seesaw, so that the petal 60 would accordingly turn over as closed conforming to the movement of the swinging member 50 (as shown in FIG. 9). At the same time, the controlling circuit would control the radiate member 80 to radiate as a decoration to produce a graceful ornamental effect thereof.

As it should be, the controlling circuit and the operating pattern are not limited to the content as disclosed in the preferred embodiment of the present invention because the design can be alternatively adjusted as practically needed.

To sum up, the present invention takes advantages of the solar energy to provide a driving unit with electricity to trigger a movable tray to move up- and downward. With further cooperation to a swinging member, the movable tray and the swinging member would motivate the movement of the petals so as to simulate the blossom or closed state of the petals in reality. As a result, the present invention would evidently distinguish from the conventional static to perform a new type of flower with dynamic simulation. Moreover, the solar energy would further control the petals of the present invention to bloom in the daytime and to be closed with a radiate member turning on at the night. That is to say, the ornamental states are automatically varied according to the variation of the natural environment, so that a multiple attractive function can be attained, and the decoration is adapted to Nature, which is more close to the actuality. As a result, the artistic effect and the market competitiveness of the product are both significantly enhanced.

While we have shown and described the embodiment in accordance with the present invention, it should be clear to those skilled in the art that further embodiments may be made without departing from the scope of the present invention.

We claim:

1. A solar powered flower of dynamic simulation comprising a stem, a solar power supplier, a connecting base, a driving unit, a movable tray, at least one swinging member, and at least one petal; wherein, a sharp pointed portion being disposed at a distal end of said stem, said connecting base being fixedly installed on a top end of said stem, at least one inlaying slot being disposed on the periphery of said connecting base for said swinging member to be correspondingly pivoted therein, said petal being mounted on an upper arm of said swinging member, said movable tray being pivoted on a lower arm of said swinging member, and said driving unit connected with said solar power supplier being provided with a working power therefrom; an output terminal of said driving unit contacting said movable tray, so that said movable tray would be pushed forward to bring the swinging member to vacillate as a seesaw, and said petal would be accordingly moved conforming to the movement of said swinging member.

2. The solar powered flower of dynamic simulation as claimed in claim 1, wherein, said connecting base includes an upper base and a lower base; a receiving room is defined on the top side of said lower base, and said upper base is hermetically disposed upon a cavity of said receiving room; said driving unit is received in said receiving room, and said inlaying slot is disposed on said upper base.

3. The solar powered flower of dynamic simulation as claimed in claim 1, wherein, said driving unit includes a motor, a gear set, and a slider; said slider further provides with an over-and-under extended rack to mesh with a propelling gear of said gear set; said motor would motivate said gear set to rotate clockwise or opposite, said gear set would further prompt said slider to move upward and downward, and said movable tray fixedly mounted on said slider would be accordingly moved conforming to said slider.

4. The solar powered flower of dynamic simulation as claimed in claim 1, wherein, an opening is defined on said lower arm of said swinging member, and a plurality of shafts are correspondingly installed on said movable tray to pivot into said opening and form a pivoted structure between said swinging member and said movable tray.

5. The solar powered flower of dynamic simulation as claimed in claim 1, wherein a radiate member is further installed in said connecting base and to be electrically connected with the solar power supplier.

6. The solar powered flower of dynamic simulation as claimed in claim 1, wherein said solar power supplier comprises a solar energy board, a rechargeable battery, and a controlling circuit; said rechargeable battery is charged by the conversion from light energy absorbed in said solar energy board into electric energy so as to provide said driving unit with sufficient working power.

7. The solar powered flower of dynamic simulation as claimed in claim 6, wherein said stem further provides with a stand, said solar energy board is disposed on a battery container, and said battery container is mounted on said stand.

8. The solar powered flower of dynamic simulation as claimed in claim 7, wherein said stand includes two pallets, between which an axle is disposed, and a protrusion is defined on the inner wall of said at least one pallet;

a protruding member disposed on said battery container provides with an aperture, a plurality of spacing indentations are defined on at least one side wall of said protruding member, and said spacing indentations are uniformly distributed on the periphery of said aperture;

said protruding member is clipped between said two pallets, said axle is pivotally inserted into said aperture, said protrusion is correspondingly embedded into said related spacing indentation for said battery container to form a spinning structure on said stand.

* * * * *